United States Patent [19]

Sheludko et al.

[11] 4,407,715

[45] Oct. 4, 1983

[54] METHOD OF AND APPARATUS FOR THE FLOTATION PROCESSING OF MINERALS

[75] Inventors: Alexey D. Sheludko; Rumen V. Ivanov; Dobrin V. Nikolov; Ivan M. Nishkov, all of Sofia, Bulgaria

[73] Assignee: Institute Po Physikochimia pri Ban, Sofia, Bulgaria

[21] Appl. No.: 316,077

[22] Filed: Oct. 28, 1981

Related U.S. Application Data

[63] Continuation-in-part of Ser. No. 816,817, Jul. 18, 1977, abandoned, Ser. No. 961,100, Nov. 16, 1978, abandoned, and Ser. No. 87,977, Oct. 25, 1979, abandoned.

[30] Foreign Application Priority Data

Jul. 16, 1976 [BG] Bulgaria ..... 33774

[51] Int. Cl.[3] ..... B03D 1/02; B03D 1/14

[52] U.S. Cl. ..... 209/164; 209/168; 210/221.2

[58] Field of Search ..... 209/168, 170, 164, 165, 209/9, 207, 1, 10; 210/221.1, 221.2

[56] References Cited

U.S. PATENT DOCUMENTS

| | | | |
|---|---|---|---|
| 1,263,503 | 4/1918 | Wood | 209/207 |
| 1,497,804 | 6/1924 | Spearman | 209/207 X |
| 1,608,896 | 11/1926 | MacIntosh | 209/170 |
| 1,713,046 | 5/1929 | MacIntosh | 209/170 X |
| 1,755,614 | 4/1930 | Seil | 209/170 X |
| 1,810,394 | 6/1931 | Dyhr | 209/170 X |
| 2,293,469 | 8/1942 | Maust et al. | 209/207 |
| 3,202,281 | 8/1965 | Weston | 209/166 |

FOREIGN PATENT DOCUMENTS

| | | | |
|---|---|---|---|
| 732892 | 6/1955 | United Kingdom | 209/168 |

*Primary Examiner*—Ralph J. Hill

[57] ABSTRACT

Method of and apparatus for the flotation processing of minerals. The starting material is pretreated by means of flotation agents and is then spread in the form of a controllable thin film over a fixed perforated controllable-surface drum, the so-obtained suspension-film is blown through by an airstream from the inner to the outer side of said drum, and the stability or the composition of the frothed layer or of the unfrothed layer over the surface of the suspension is controlled.

16 Claims, 2 Drawing Figures

METHOD OF AND APPARATUS FOR THE FLOTATION PROCESSING OF MINERALS

This application is a continuation-in-part of application Ser. No. 816,817 filed July 18, 1977, now abandoned, of application Ser. No. 961,100, filed Nov. 16, 1978, now abandoned, and of application Ser. No. 87,977, filed Oct. 25, 1979, now abandoned.

This invention relates to a method of and an apparatus for the flotation processing of minerals.

There are well-known methods of mineral-flotation based upon contact between the mineral particles to be flotation-processed and the interphase liquid-to-air surface.

The most widely used flotation method, the so-called foam (froth) flotation is linked to a very intensive stirring of the pulp contributing to a better dispersion of the gas and solid phases.

Film flotation is well-known, wherein material comprising flotation agents is laid upon the liquid-air surface.

There is a method of flotation-processing wherein the contacting is conducted in a thin film, using vacuum conditions. The apparatus for carrying out this method employs a bath, a perforated revolving drum, and a vacuum installation.

The drawbacks of froth flotation are that with an intense stirring of the pulp, the dispersing forces are increased many times (due to the appearance of centrifugal forces, largely exceeding the weight of the mineral particles), while the time to ensure contact is on the order of milliseconds, which is insufficient for the broadening of the contacting perimeter to sizes which would ensure the flotation of large particles.

The film flotation entails the necessity of overcoming a plurality of thick fluid films which cannot be compensated by the absence of centrifugal dispersing forces; as a result, the process as a whole is not sufficiently selective and efficient.

The above-mentioned shortcomings are also more or less frequently encountered in the combination of the froth and film flotation processes, i.e., the flotation-gravitational and flotation-granulating methods of processing the minerals.

The drawbacks of the known flotation processes are as follows:

- a small interphase contacting surface;
- the presence of an upper limit of vacumization defined by capillary forces, which delays the kinetics of contacting mineral particles;
- large adhesive forces between the particles and the filtrating surfaces-leading to an insufficient use of the contacting surface.

The shortcomings of the existing devices for the implementation of the known methods of flotation processing are as follows:

- a continuous worsening of the vacuum conditions due to the jamming of the pores;
- difficulties when utilizing the filtrate; and finally
- a low productivity of the process.

The present invention provides a method of and an apparatus for a maximal and selective flotation of minerals, sized up to 3 mm, featuring good productivity and constant qualities of the process.

According to the invention, this object is achieved by treating the starting material by flotation agents and by further spreading the thus-treated material in the form of a thin, controllable film over a perforated controllable-surface fixed drum, said material being blown through an airstream under a pressure not higher than 3 atm, from the inner to the outer side of said drum, controlling the stability or the composition of the obtained froth, or the composition of the unfrothed layer consisting of the air-contacted particles, over the surface of the suspension. The new flotation method possesses the following features:

- contacting of mineral-particles with air by means of the frothing of a thin (up to several millimeters thick) layer of pulp;
- a controllable destruction to a necessary degree of the so-obtained three-phase froth, or the air contacting the impurities in the unfrothed layer (when there is a lack of any frothed layer on the surface of the pulp), wherein the best possible selectivity of the flotation can be achieved;
- a controllable and very extensive (up to $10^3$ times compared to the conventional froth flotation) contact time of particles-to-air is ensured. With the existing methods of froth flotation, this contact times amounts to some milliseconds and is automatically set by the pulp and froth-mixing conditions. According to the present invention, said contact-time is controllable by the following factors:
  - a. selection of a desired size of holes of the porous material embracing the perforated drum surface, thus obtaining a desired mode of controlling the growth and coalescence of bubbles over said surface, which defines the rate of contacting of the particles with the moving interphase air-to-water surface and the depth of the border hydrodynamic layer of bubbles, and, therefore, the possibility of flotation;
  - b. the selection of an adequate depth (a few millimeters) of the thin pulp-layer in order to ensure a minimum rate of collision and therefrom the longest possible time of contact, due to the delay of the final rising velocity of bubbles. This makes possible the flotation of particles, sized under 5 microns, which, under conditions of the conventional flotation process, do not float due to the hydrodynamic resistance at their contacting;
  - c. The programmed viscosity and density of the pulp in the thin layer, effected by means of its controlled frothing.

The apparatus according to the invention comprises a feeding box, a bath with controllable discharging outlets, movable discharging gates, and chutes for collecting the top product, wherein the bath includes a fixed drum with a perforated controllable surface connected with a compressed air supply, both sides of said bath comprising movable gates, a circulation compartment with a valve, the top of said bath featuring a set of froth-controlling devices. The fixed drum with the perforated controllable surface may be of circular cylindrical, elliptical, hyperbolic, parabolic, or multilateral shape (profile) in cross-section.

The perforated surface is controllable since the design makes it possible to select, and, therefore to control, the apertures of the porous material tightly embracing the cylindrical surface of the drum and responsible for the efficient aeration of the thin pulp film; also, by selecting an adequate profile of the aerating surface, it is possible to ensure different times of contact between the particles and the bubbles. Hence the profile of the aeration surface may be specifically optimized for every type of material, depending upon its screen composition and flotability.

The advantages of the invention are as follows:

a good selectivity, good productivity, efficient large sized particle flotation, good stability of the process over a period of time, full use of cheap frothers for the unstable froth and finally, the apparatus is free of moving parts and is easy to operate.

The apparatus of the invention is illustrated in the drawings, wherein.

Figure 1:
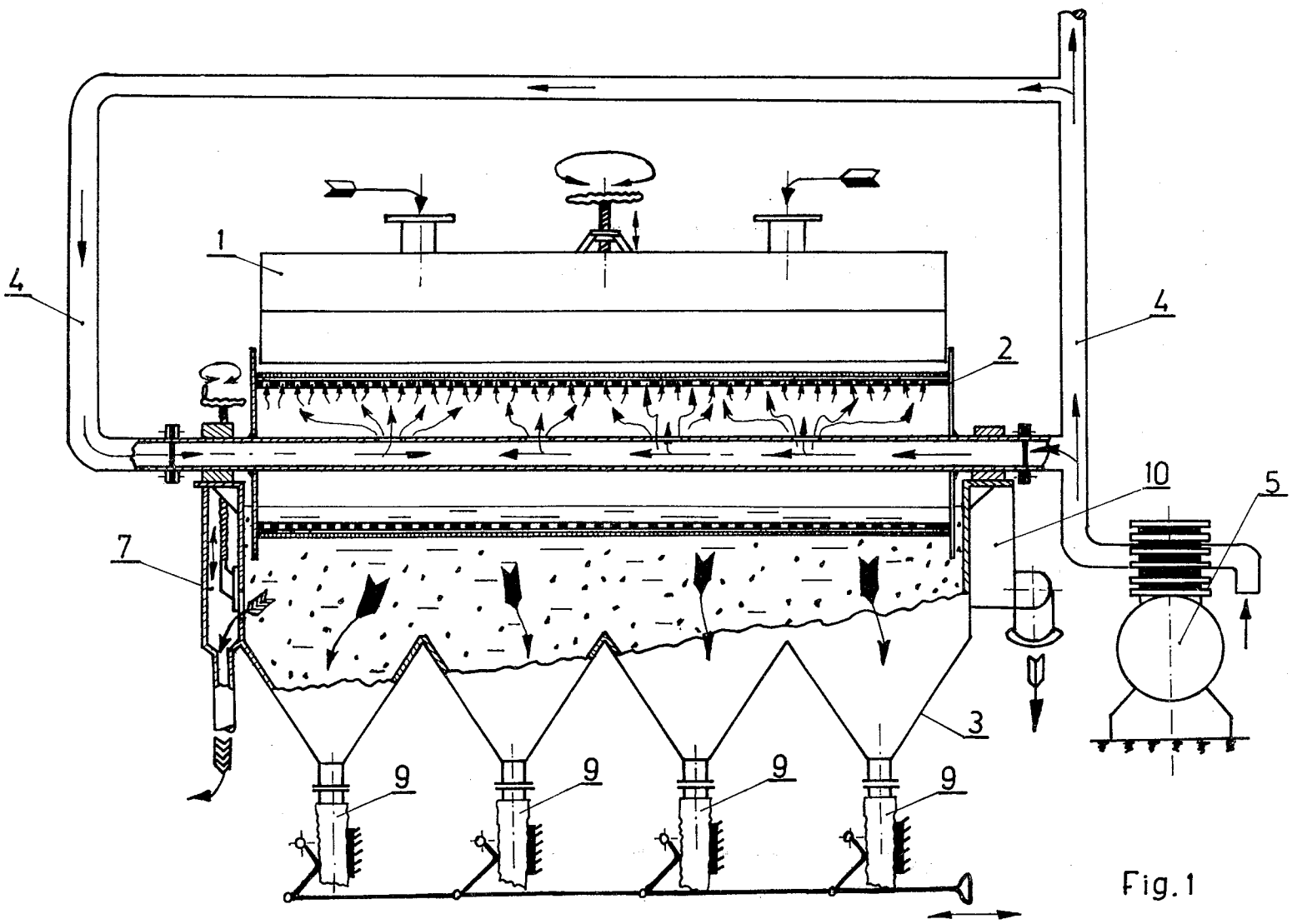
FIG. 1 is a front view of the apparatus with some partial cross-sections.

The apparatus according to the invention comprises a feeding box 1, whereunder a fixed (non-rotatable) perforated and controllable-surface drum 2 is located, said drum being partially immersed in the bath 3. Said drum 2 is connected by means of tube 4 a compressed air supply 5. Both sides of bath 3 are provided with movable discharging gates 6 and a circulation compartment with a valve 7. Above the bath there are provided froth stability regulating devices 8, while the bottom of said bath is provided with controllable outlets 9.

Figure 2:
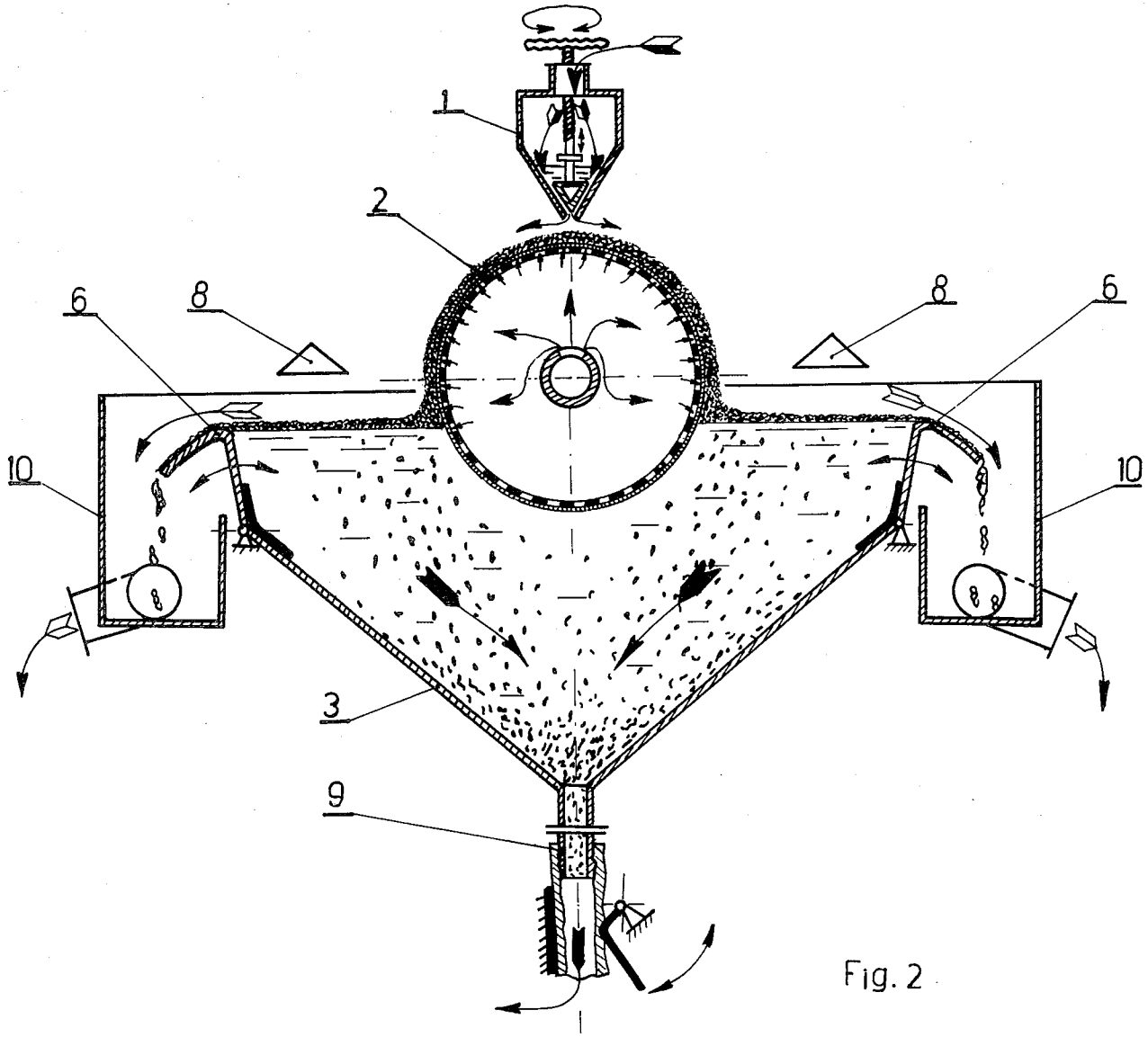
FIG. 2 is a cross-sectional view of the apparatus of FIG. 1.
Figure 4:
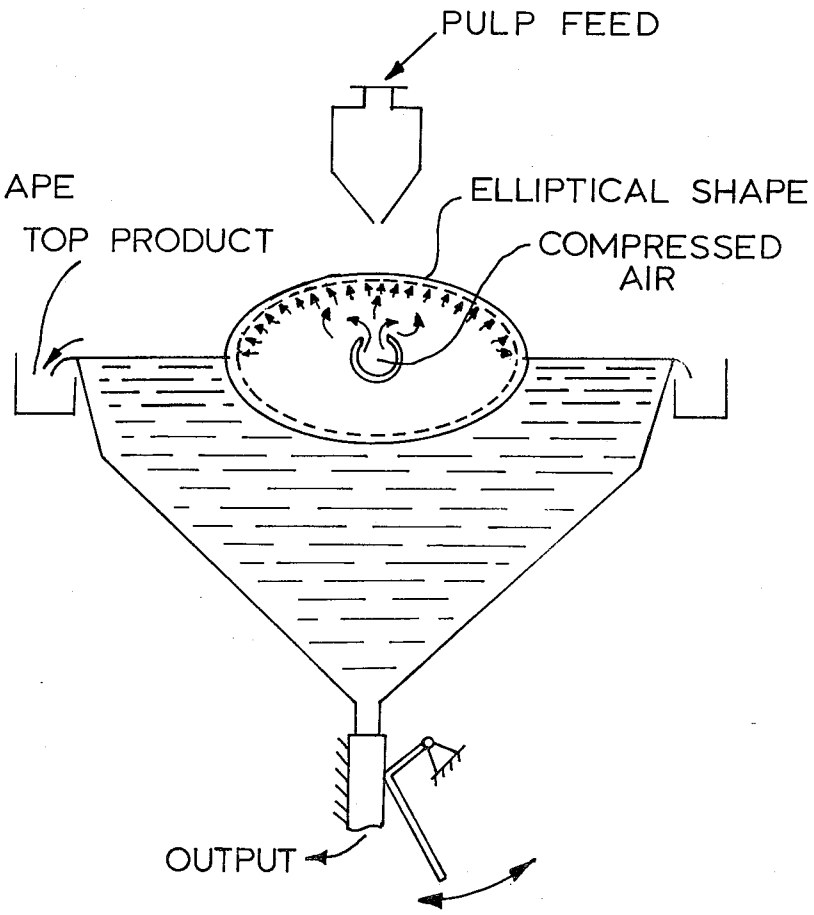
FIG. 4 is a view similar to FIG. 3 of an embodiment of the apparatus wherein the drum is of elliptical shape.
Figure 3:
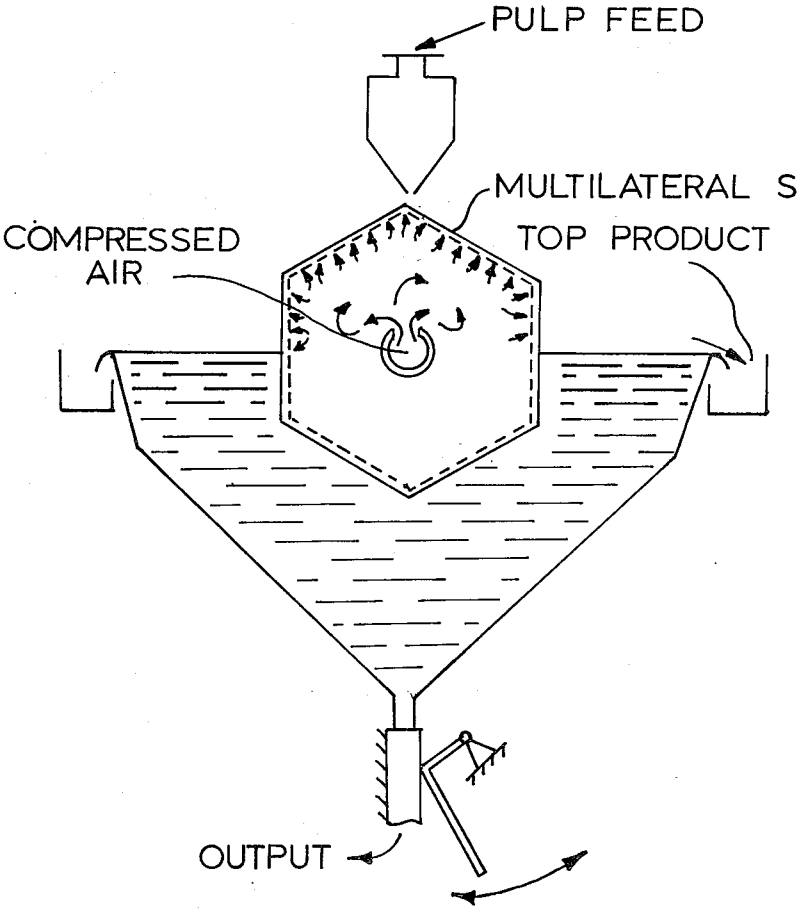
FIG. 3 is a schematic view in vertical cross-section of an embodiment of the apparatus wherein the drum is of multilateral shape.
Figure 6:
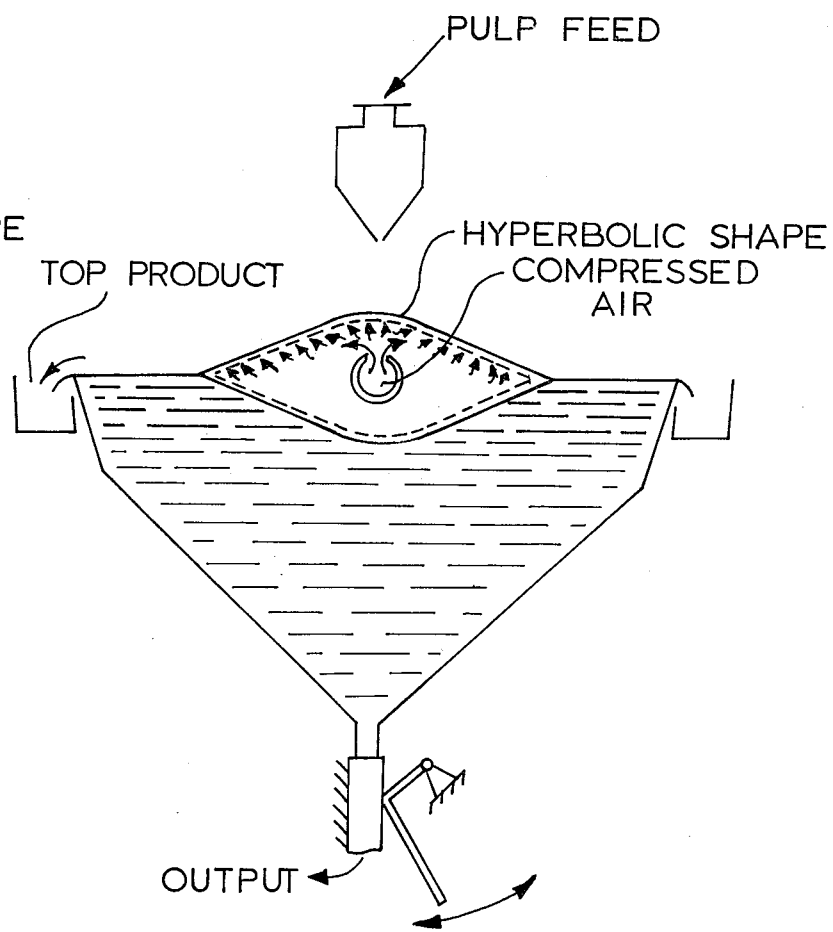
FIG. 6 is a view similar to FIG. 3 of an embodiment of the apparatus wherein the drum is of hyperbolic shape.
Figure 5:
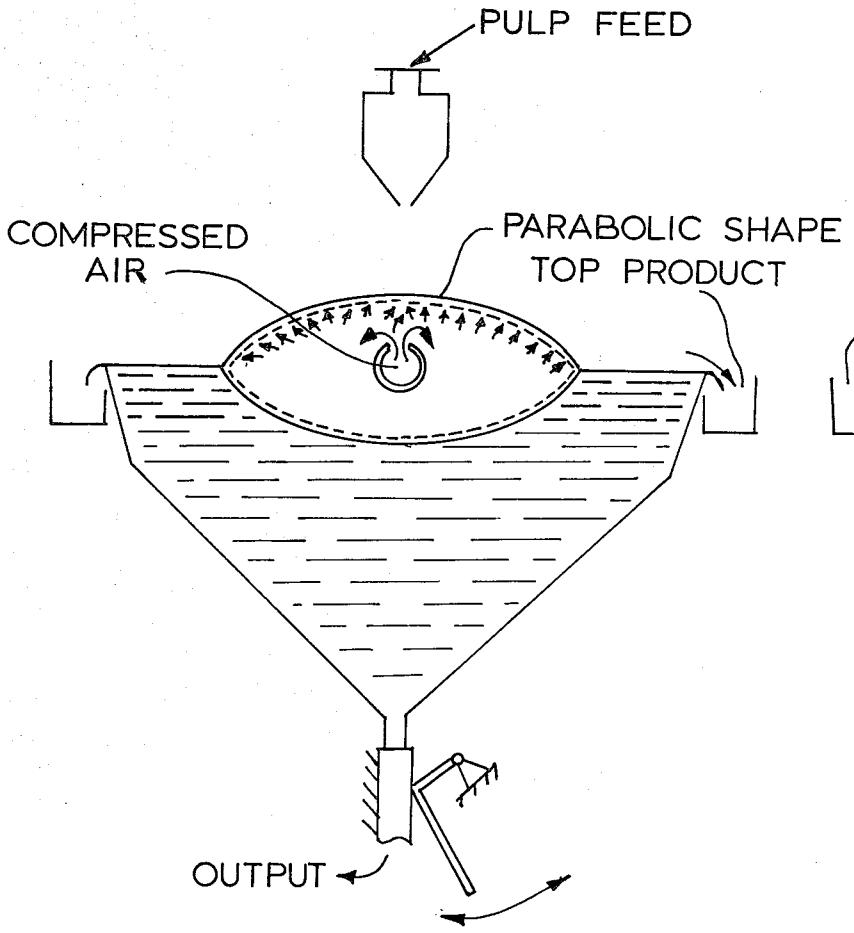
FIG. 5 is a view similar to FIG. 3 of an embodiment of the apparatus wherein the drum is of parabolic shape.

The suspension, pretreated with flotation agents, is fed via the feeding box 1 in the form of a thin (only a few millimeters thick) layer to the exposed top of the controllable and perforated surface drum 2. Then, from the compressed-air supply 5 an airstream is introduced into the drum 2, the airstream being dispersed into fine bubbles by using a filter of porous material through which the air flows, breaking up the so-obtained suspension layer, thus obtaining the contact of the mineral granules with the air phase. The so-obtained, almost bi-dimensional and three-phased froth (there is no spray) flows into the bath 3 down along the exposed upper surface of the controllable perforated-surface drum in the form of a pulp, wherein there remain only those mineral granules which had already contacted and widened their contact to such a degree as to ensure a sufficient adhesion. These granules are discharged through the movable gates 6 to chutes 10 as shown in FIG. 2. The adhered particles (the tailing component) are submerged in the volume of pulp and are then discharged through the controllable outlets 9. The pulp level in the bath 3 is maintained by control of valve 7.

In those cases in which a frothing layer exists upon the pulp surface, the same is partially destroyed by the froth-stability-regulating units 8, which may be mechanical, ultrasonic, electrostatic, etc., whereby narrowed (minimal-surface) conditions are purposely created, thus securing the most selective separation of minerals.

In accordance with the invention, the stability of frothed or unfrothed layers or films is controlled by the quantity and the composition of the mineral particles contacted therein. The number and the character of these particles determine the mechanics of the layers—i.e., the angles of contact, the kinetics of expansion of the three-phase contact, the hysteresis effects, etc. In practice, the quantity and the composition of the contacting particles is controlled by the froth-stability control device, i.e., by untrasonic vibrations, etc.

The apparatus of the invention makes it possible to select, and therefore to control, the apertures of the porous material, tightly embracing the cylindrical surface of the drum and responsible for the efficient aeration of the thin pulp film. For example, apertures in the range of 5 to 30 microns ensure the obtaining of bubbles of 100 to 150 microns in diameter, having Stokes-flow character of motion. If the porous material would have apertures in the range of 70 to 100 microns, then the bubbles would be of 500 to 1500 microns in diameter with a potential flow regime of motion. It also seems possible to use apertures of 30 to 100 microns or combinations of aforesaid ranges, in order to obtain an intermediate hydrodynamic regime.

By selecting an adequate form (or profile) of the aerating surface, it is possible to ensure different times of contact between the particles and the bubbles, hence the profile of the aerating surface may be specifically optimized for every type of mineral, depending upon its screen composition and floatability.

The particles in the thin pulp film are contacted with air, only when the thin liquid films between said particles and the air reach their critical thickness and are therefore torn at the formation of the three-phase contact. The probability of this to be effected for all the particles and for a single passage of the thin pulp-film over the perforated surface of the drum is very small. Usually, the contact is effected by those particles, which are in the front part of the boundary hydrodynamic layer of the bubbles.

The term employed above, "controllable perforated drum", will be clarified by the following: By controlling the air pressure, the size of the openings on the perforated material around the drum can be changed. The number of the openings is constant. The drum profile in cross-section is constant as well. Depending on the treated starting material qualities at a given operation one can select the drum profile and the number and size of the openings of perforated material around the drum.

According to the present method the top product can be separated in the form of a frothed layer or an unfrothed layer—when the froth cannot be formed because of the chemical composition of the pulp, for example in very acid pulps in the presence of xanthate. These products, either frothed or unfrothed layer, are unloaded in the chutes 10, and through the apertures 9 there is unloaded only the tailing component.

The term "controlling the composition", referring to the pulp suspension film means that in accordance with the invention such layer can become more or less rich in the mineral being recovered. The limits of this alteration can range from a minimum (the starting ore) to a maximum (the pure mineral recovered). The fixed drum of the flotation machine does not remain one and the same in all cases of using this method and machine. It is selected according to the kind of mineral being processed. When carrying out this selection it is possible to modify: its cross-section, the size of the apertures therein, and the material of the porous substance which covers it and let air pass and the pressure of the compressed air. In this sense the drum is "controllable", therefore it is called a "controllable-surface drum".

Although the invention is illustrated and described with reference to a single preferred embodiment thereof, it is to be expressely understood that it is in no way limited to the disclosure of such a preferred embodiment, but is capable of numerous modifications within the scope of the appended claims.

I claim:

1. A method of flotation-processing minerals in particulate form, comprising pretreating of the starting mineral material by means of flotation agents to form a pulp suspension, fixedly positioning a drum with its longitudinal axis horizontal, with its lower portion immersed in a bath of said pulp suspension, and with its upper portion exposed above the upper surface of said bath, the drum having a perforated peripheral surface the apertures in which are controllable as to size, spreading the pretreated starting material in the form of a thin pulp suspension film over the exposed upper surface of the drum, blowing a compressed air stream upwardly through the pulp suspension film on the exposed upper surface of the drum from the inner to the outer surface of the drum whereby to form a forth thereon, discharging the froth and the mineral granules adhering thereto from the froth on the exposed upper surface of the bath, and discharging the material in the pulp suspension including unadhered mineral particles submerged in the bath from a lower portion of the bath.

2. The method according to claim 1, wherein the compressed air stream is under a pressure not higher than 3 atm.

3. The method according to claim 1, wherein the stability of the forth layer on the surface of the pulp bath is regulated by froth-stability regulating devices disposed above the bath.

4. The method according to claim 1, wherein the perforated and controllable-surface drum has a circular cylindrical shape in cross-section.

5. The method according to claim 1, wherein the perforated and controllable-surface drum has a multilateral shape in cross-section.

6. The method according to claim 1, wherein the perforated and controllable-surface drum has an elliptical shape in cross-section.

7. The method according to claim 1, wherein the perforated and controllable-surface drum has a parabolic shape in cross-section.

8. The method according to claim 1, wherein the perforated and controllable-surface drum has a hyperbolic shape in cross-section.

9. Apparatus for the flotation-processing of minerals in particulate form, the starting mineral material for which has been pretreated by means of flotation agents to form a pulp suspension, comprising means containing a bath of said pulp suspension, a drum fixedly positioned with its longitudinal axis horizontal, with its lower portion immersed in the bath of said pulp suspension, and with its upper portion exposed above the upper surface of said bath, the drum having a perforated peripheral surface the apertures in which are controllable as to size, means for spreading the pretreated starting material in the form of a thin pulp suspension film over the exposed upper surface of the drum, means for blowing a compressed air stream upwardly through the pulp suspension film on the upper surface of the drum from the inner to the outer side of the drum whereby to form a froth thereon, the froth spreading over the upper surface of the bath, means to discharge the froth and the mineral granules adhering thereto from the froth on the exposed upper surface of the bath, and means to discharge the material in the pulp suspension including unadhered mineral particles submerged in the bath from a lower portion of the bath.

10. An apparatus according to claim 9, wherein the perforated and controllable-surface drum has a circular cylindrical shape in cross-section.

11. An apparatus according to claim 9, wherein the perforated and controllable-surface drum has a multilateral shape in cross-section.

12. An apparatus according to claim 9, wherein the perforated and controllable-surface drum has an elliptical shape in cross-section.

13. An apparatus according to claim 9, wherein the perforated and controllable-surface drum has a parabolic shape in cross-section.

14. An apparatus according to claim 9, wherein the perforated and controllable-surface drum has a hyperbolic shape in cross-section.

15. An apparatus according to claim 9, comprising froth-stability controlling devices disposed above the froth layer on the top of the bath of pulp suspension.

16. An apparatus according to claim 15, wherein said means for discharging froth and mineral granules adhering thereto from the top of the bath comprises movable gates disposed on both sides of the bath, and comprising a circulation compartment and a valve for controlling the level of pulp in the bath.

* * * * *